US010157571B2

(12) United States Patent
Zhu

(10) Patent No.: US 10,157,571 B2
(45) Date of Patent: Dec. 18, 2018

(54) DISPLAY PANEL, METHOD FOR DRIVING THE SAME AND DISPLAY DEVICE

(71) Applicants: BOE TECHNOLOGY GROUP CO., LTD., Beijing (CN); ORDOS YUANSHENG OPTOELECTRONICS CO., LTD., Inner Mongolia Autonomous Region (CN)

(72) Inventor: Jianchao Zhu, Beijing (CN)

(73) Assignees: BOE TECHNOLOGY GROUP CO., LTD. (CN); ORDOS YUANSHENG OPTOELECTRONICS CO., LTD. (CN)

( * ) Notice: Subject to any disclaimer, the term of this patent is extended or adjusted under 35 U.S.C. 154(b) by 32 days.

(21) Appl. No.: 15/309,475

(22) PCT Filed: Feb. 1, 2016

(86) PCT No.: PCT/CN2016/073042
§ 371 (c)(1),
(2) Date: Nov. 8, 2016

(87) PCT Pub. No.: WO2017/049826
PCT Pub. Date: Mar. 30, 2017

(65) Prior Publication Data

US 2017/0263180 A1 Sep. 14, 2017

(30) Foreign Application Priority Data

Sep. 25, 2015 (CN) ..... 2015 1 0622907

(51) Int. Cl.
*G09G 3/3266* (2016.01)
*G09G 3/3233* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC ..... G09G 3/006; G09G 3/3225; G09G 2310/0251; H01L 27/3244
See application file for complete search history.

(56) References Cited

U.S. PATENT DOCUMENTS

2011/0164016 A1 7/2011 Kang et al.
2012/0026143 A1 2/2012 Jang
(Continued)

FOREIGN PATENT DOCUMENTS

CN 101093639 12/2007
CN 103218972 7/2013
(Continued)

OTHER PUBLICATIONS

Written Opinion and International Search Report for PCT/CN2016/073042, English Translation of Written Opinion Attached to Original Document, Completed by the Chinese Patent Office, dated May 21, 2016, All together 15 Pages.
(Continued)

*Primary Examiner* — Robert Michaud
(74) *Attorney, Agent, or Firm* — Brooks Kushman P.C.

(57) ABSTRACT

The present disclosure provides a display panel, a method for driving the same and a display device. A pixel circuit of the display panel includes a storage capacitor, a driving transistor, an initialization module configured to apply an initial voltage to a first end of the storage capacitor via a current-level gate scanning line within an initialization time period, a compensation module, a data writing module, a resetting module configured to enable the current-level gate scanning line to be electrically connected to a second end of
(Continued)

the storage capacitor within a light-emitting time period, and a light-emitting control module. The driving transistor is in an on state within the light-emitting time period, so as to drive a light-emitting element to emit light.

14 Claims, 2 Drawing Sheets

(52) U.S. Cl.
CPC ..... *G09G 2300/043* (2013.01); *G09G 2310/0202* (2013.01); *G09G 2310/08* (2013.01); *G09G 2320/0233* (2013.01)

(56) References Cited

U.S. PATENT DOCUMENTS

2014/0320550 A1* 10/2014 Liao ..... G09G 3/3225 345/690
2015/0009105 A1* 1/2015 Nomura ..... G09G 3/006 345/76

FOREIGN PATENT DOCUMENTS

| | | |
|---|---|---|
| CN | 103258501 | 8/2013 |
| CN | 103943060 | 7/2014 |
| CN | 104123908 | 10/2014 |
| CN | 204029330 | 12/2014 |
| CN | 104658484 | 5/2015 |
| CN | 105096838 | 11/2015 |

OTHER PUBLICATIONS

Chinese Office Action for Chinese Application No. 201510622907.6, English Translation attached to original document, Completed by the Chinese Patent Office, dated Oct. 25, 2016, All together 15 Pages.
Third Office Action for Chinese Application No. 201510622907.6, dated Oct. 27, 2017, 8 Pages.
Second Office Action for Chinese Application No. 201510622907.6, dated Jul. 28, 2017, 8 Pages.

* cited by examiner

DISPLAY PANEL, METHOD FOR DRIVING THE SAME AND DISPLAY DEVICE

CROSS-REFERENCE TO RELATED APPLICATIONS

This application is the U.S. national phase of PCT Application No. PCT/CN2016/073042 filed on Feb. 1, 2016, which claims priority to Chinese Patent Application No. 201510622907.6 filed on Sep. 25, 2015, the disclosures of which are incorporated in their entirety by reference herein.

TECHNICAL FIELD

The present disclosure relates to the field of display technology, in particular to a display panel, a method for driving the same and a display device.

BACKGROUND

Recently, a typical display panel has been gradually replaced with a portable flat display panel, and an organic light-emitting display panel has attracted more and more attentions due to such features as high brightness, wide viewing angle, high contrast, low power consumption and quick response.

However, in the case that an active-matrix organic light-emitting diode (AMOLED) display panel has a higher and higher resolution, it is impossible to provide a sufficient wiring space due to a reduction in the pixel area. Especially in the case that the number of thin film transistors in a pixel circuit is irreducible, it is necessary to reduce the number of power lines. In addition, due to a low temperature polysilicon (LTPS) technology, a threshold voltage of the TFT in each pixel may be offset to different extents, and thereby the uneven brightness may occur for an image. Hence, there is an urgent need to provide an AMOLED display panel including a pixel circuit capable of eliminating the above-mentioned defects.

SUMMARY

A main object of the present disclosure is to provide a display panel, a method for driving the same and a display device, which can solve the problem in the related art that the brightness evenness of the display panel cannot be improved without reducing the pixel area.

In order to achieve the above object, the present disclosure provides a display panel, including a display substrate, a plurality of gate scanning lines on the display substrate, a plurality of data lines on the display substrate, and a plurality of pixel circuits. The plurality of gate scanning lines crosses the plurality of data lines, and each pixel circuit is at a pixel region defined by two adjacent gate scanning lines and two adjacent data lines. Each pixel circuit includes:

a storage capacitor;

a driving transistor, a gate electrode of which is connected to a first end of the storage capacitor, and a first electrode of which is configured to receive a first power voltage;

an initialization module, a first end of which is connected to a current-level gate scanning line, a second end of which is connected to the first end of the storage capacitor, and which is configured to enable the current-level gate scanning line to apply an initial voltage to the first end of the storage capacitor within an initialization time period of each display period;

a compensation module configured to enable the gate electrode of the driving transistor to be electrically connected to a second electrode of the driving transistor within a threshold compensation time period of each display period;

a data writing module configured to write a data voltage into a second end of the storage capacitor within the threshold compensation time period of each display period;

a resetting module, a first end of which is connected to the current-level gate scanning line, a second end of which is connected to the second end of the storage capacitor, and which is configured to enable the current-level gate scanning line to be electrically connected to the second end of the storage capacitor within a light-emitting time period of each display period; and a light-emitting control module configured to enable the second electrode of the driving transistor to be electrically connected to a light-emitting element within the light-emitting time period of each display period.

The driving transistor is in an on state within the light-emitting time period of each display period so as to drive the light-emitting element to emit light.

Optionally, the initialization module includes an initialization transistor, a gate electrode of which is connected to a previous-level gate scanning line, a first electrode of which is connected to the current-level gate scanning line, and a second electrode of which is connected to the first end of the storage capacitor.

Optionally, the compensation module includes a compensation transistor, a gate electrode of which is connected to the current-level gate scanning line, a first electrode of which is connected to the second electrode of the driving transistor, and a second electrode of which is connected to the first end of the storage capacitor.

Optionally, the data writing module includes a data writing transistor, a gate electrode of which is connected to the current-level gate scanning line, a first electrode of which is connected to the second end of the storage capacitor, and a second end of which is configured to receive the data voltage.

Optionally, the resetting module includes a resetting transistor, a gate electrode of which is configured to receive a light-emitting control signal, a first electrode of which is connected to the second end of the storage capacitor, and a second electrode of which is connected to the current-level gate scanning line.

Optionally, the light-emitting control module includes a light-emitting control transistor, a gate electrode of which is configured to receive the light-emitting control signal, a first electrode of which is connected to the second electrode of the driving transistor, and a second electrode of which is connected to the light-emitting element.

Optionally, the driving transistor, the initialization transistor, the compensation transistor, the data writing transistor, the resetting transistor and the light-emitting control transistor are all p-type transistors.

The present disclosure provides in some embodiments a method for driving the above-mentioned display panel, including:

an initialization step of, within an initialization time period of each display period, enabling, by an initialization module, a current-level gate scanning line to apply an initial voltage to a first end of a storage capacitor;

a threshold compensation step of, within a threshold compensation time period of each display period, writing, by a data writing module, a data voltage Vdata into a second end of the storage capacitor, and enabling, by a compensation module, a gate electrode of a driving transistor to be electrically connected to a second electrode of the driving transistor; and a light-emitting step of, within a light-emitting time period of each display period, enabling, by a resetting module, a current-level gate scanning line to be electrically connected to the second end of the storage capacitor, and enabling, by a light-emitting control module, the second end of the driving transistor to be electrically connected to a light-emitting element, so as to enable the driving transistor to be in an on state, thereby to drive the light-emitting element to emit light.

Optionally, in the case that the driving transistor is a p-type transistor, a first power voltage is a high level VDD and the initial voltage is a high level. The threshold compensation step includes: within the threshold compensation time period of each display period, enabling the driving transistor to be in diode conducting state until a potential at the gate electrode of the driving transistor is pulled up to VDD+Vth, where Vth is a threshold voltage of the driving transistor, and tuning off the driving transistor. A difference between potentials at the second end of the storage capacitor and at the first end of the storage capacitor being Vdata−VDD−Vth.

The light-emitting step includes, within the light-emitting time period of each display period, enabling the current-level gate scanning line to output a current-level gate scanning signal VSn at a high level, so as to enable the first end of the storage capacitor to be in a floating state, enable the potential at the first end of the storage capacitor to jump to VDD+Vth−Vdata+VSn and enable a gate-to-source voltage Vgs of the driving transistor to be VSn−Vdata, thereby to enable an on-state current of the driving transistor being irrelevant to Vth and VDD.

Optionally, before the initialization step, the method further includes a first preparation step of enabling a previous-level gate scanning line to output a high level, and enabling the current-level gate scanning line to output a high level, so as to enable the driving transistor, an initialization transistor, a compensation transistor and a data writing transistor to be in an off state, and pull up a light-emitting control signal from a low level to a high level, thereby to enable a resetting transistor and a light-emitting control transistor to be switched from an on state to an off state.

After the initialization step and before the threshold compensation step, the method further includes a second preparation step of enabling the previous-level gate scanning line to output a high level so as to enable the initialization transistor to be in the off state, and enabling the current-level gate scanning line to output a high level continuously and maintaining the light-emitting control signal at a high level so as to enable the compensation transistor, the data writing transistor, the resetting transistor, the light-emitting control transistor and the driving transistor to be in the off state.

After the threshold compensation step and before the light-emitting step, the method further includes a third preparation step of enabling the previous-level gate scanning line to output a high level continuously, so as to pull up the current-level gate scanning signal from the current-level gate scanning line from a low level to a high level, and enable a difference between potentials at the first end and the second end of the storage capacitor to be Vdata−VDD−Vth.

The present disclosure provides in some embodiments a display device including the above-mentioned display panel.

Comparing with the related art, according to the display panel, its driving method and the display device in the embodiments of the present disclosure, it is able to make effective use of the current-level gate scanning signal, i.e., apply the initial voltage and the resetting voltage through the current-level gate scanning line, while preventing the occurrence of the uneven brightness of the light-emitting element caused by a threshold voltage drift of the driving transistor and an IR-drop of a power line (the IR-drop refers to a voltage decreasing or increasing phenomenon occurring at a power supply and a ground network in an integrated circuit), thereby to reduce the wires in a pixel space and facilitate to display an image at a high resolution.

DETAILED DESCRIPTION

The technical solutions of the embodiments of the present disclosure will be described hereinafter in a clear and complete manner in conjunction with the drawings of the embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
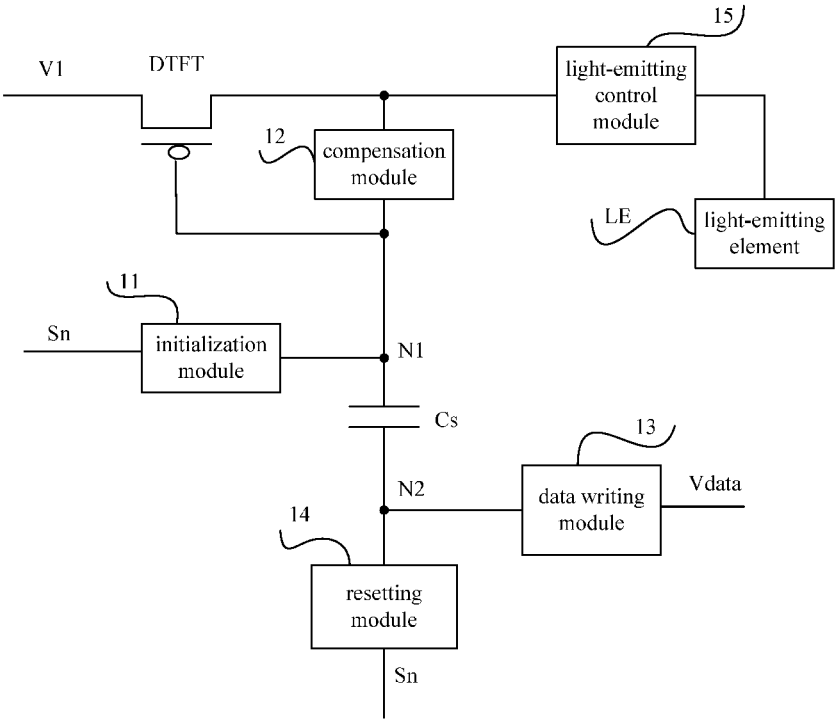
FIG. 1 is a schematic view showing a pixel circuit included in a display panel according to one embodiment of the present disclosure.

The present disclosure provides in some embodiments a display panel, which includes a plurality of gate scanning lines, a plurality of data lines crossing the gate scanning lines, and a plurality of pixel circuits. Each pixel circuit is formed at a pixel region defined by two adjacent gate scanning lines and two adjacent data lines. As shown in FIG. 1, the pixel circuit includes:

a storage capacitor Cs;

a driving transistor DTFT, a gate electrode of which is connected to a first end N1 of the storage capacitor Cs, and a first electrode of which is configured to receive a first power voltage V1;

an initialization module 11, a first end of which is connected to a current-level gate scanning line Sn, a second end of which is connected to the first end of the storage capacitor Cs, and which is configured to enable the current-level gate scanning line Sn to apply an initial voltage to the first end of the storage capacitor Cs within an initialization time period of each display period;

a compensation module 12 configured to enable the gate electrode of the driving transistor DTFT to be electrically connected to a second electrode of the driving transistor DTFT within a threshold compensation time period of each display period, so as to enable the driving transistor DTFT to be in a diode conducting state;

a data writing module 13 configured to write a data voltage Vdata into a second end N2 of the storage capacitor Cs within the threshold compensation time period of each display period;

a resetting module 14, a first end of which is connected to the current-level gate scanning line Sn, a second end of which is connected to the second end of the storage capacitor Cs, and which is configured to enable the current-level gate scanning line Sn to be electrically connected to the second end N2 of the storage capacitor Cs within a light-emitting time period of each display period; and a light-emitting control module 15 configured to enable the second electrode of the driving transistor DTFT to be electrically connected to a light-emitting element LE within the light-emitting time period of each display period.

The driving transistor DTFT is in an on state within the light-emitting time period of each display period so as to drive the light-emitting element LE to emit light.

Through the pixel circuit in the display panel in the embodiments of the present disclosure, the initial voltage may be applied to the first end of the storage capacitor Cs via the current-level gate scanning line Sn within the initialization time period of each display period, the current-level gate scanning line Sn may be electrically connected to the second end of the storage capacitor Cs within the light-emitting time period of each display period, and a resetting voltage may be applied to the second end of the storage capacitor Cs via the current-level gate scanning line Sn within the light-emitting time period. As a result, it is able to make effective use of current-level gate scanning signals, i.e., apply the initial voltage and the resetting voltage through the current-level gate scanning line, while preventing the occurrence of the uneven brightness of the light-emitting element caused by a threshold voltage drift of the driving transistor and an IR-drop of a power line (the IR-drop refers to a voltage decreasing or increasing phenomenon occurring at a power supply and a ground network in an integrated circuit), thereby to reduce the wires in a pixel space and then facilitate to display an image at a high resolution.

In the embodiments of the present disclosure, all the transistors may be thin film transistors (TFTs), field effect transistors (FETs) or any other elements having an identical characteristic. Apart from its gate electrode, the other two electrodes of each TFT may be called as a first electrode and a second electrode. The first electrode and the second electrode may be replaced with each other, depending on a flow direction of the current. In other words, the first electrode may be a source electrode and the second electrode may be a drain electrode, or the first electrode may be a drain electrode and the second electrode may be a source electrode. In addition, depending on its characteristic, each transistor may be an n-type transistor or a p-type transistor.

In FIG. 1, the DTFT may be a p-type TFT, and the first power voltage V1 may be a high level VDD.

During the operation of the pixel circuit included in the display panel in FIG. 1, within an initialization time period of each display period, the current-level gate scanning line Sn is enabled by the initialization module 11 to apply an initial voltage to the first end of the storage capacitor Cs, and at this time, Sn outputs a high level signal.

Within a threshold compensation time period of each display period, the data voltage Vdata is written into the second end of the storage capacitor Cs under the control of the data writing module 13, and the gate electrode of the driving transistor DTFT is electrically connected to the second end of the driving transistor DTFT under the control of the compensation module 12, so as to enable the driving transistor DTFT to be in a diode conducting state. At this time, a potential at the gate electrode of the driving transistor DTFT is VDD+Vth, and Vth is a threshold voltage of the driving transistor DTFT. A difference between potentials at the second end N2 of the storage capacitor Cs and the first end N1 of the storage capacitor Cs is Vdata−VDD−Vth.

Within a light-emitting time period of each display period, the current-level gate scanning line Sn outputs a gate scanning signal VSn at a high level, the current-level gate scanning line Sn is electrically connected to the second end N2 of the storage capacitor Cs under the control of the resetting module 14, and the second electrode of the driving transistor DTFT is electrically connected to the light-emitting element LE under the control of the light-emitting control module 15. At this time, the driving transistor is in the on state, so as to drive the light-emitting element LE to emit light. The first end N1 of the storage capacitor is in a floating state, so the potential at the first end N1 of the storage capacitor is jumped to VDD+Vth−Vdata+VSn, and a gate-to-source voltage Vgs of the driving transistor is VSn−Vdata. Hence, an on-state current of the driving transistor is irrelevant to Vth and VDD.

Figure 2:
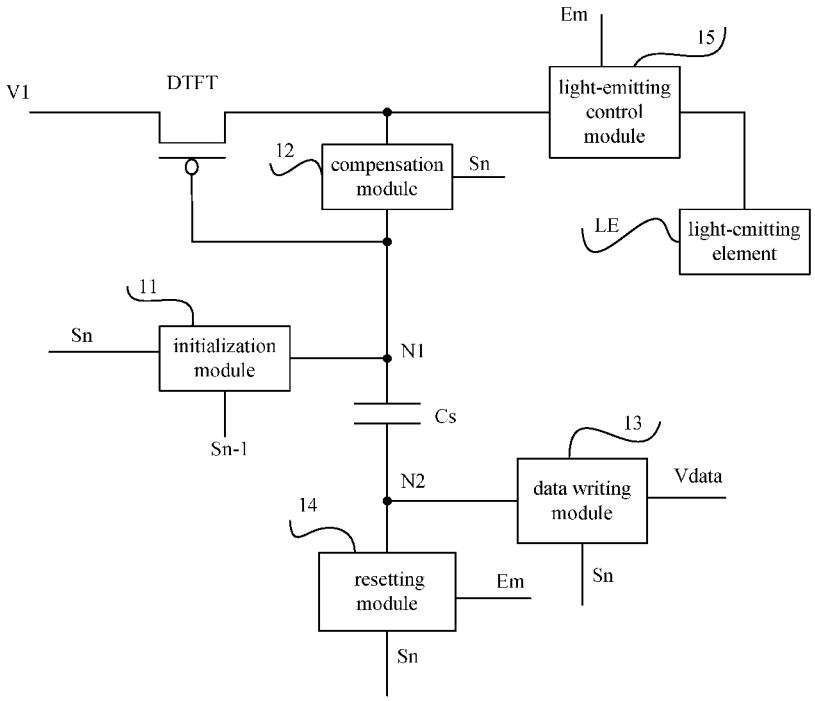
FIG. 2 is another schematic view showing the pixel circuit included in the display panel according to one embodiment of the present disclosure.

On the basis of the display panel shown in FIG. 1, as shown in FIG. 2, the initialization module 11 is further connected to a previous-level gate scanning line Sn−1, and configured to apply the initial voltage to the first end N1 of the storage capacitor Cs within the initialization time period of each display period via the current-level gate scanning line Sn under the control of a gate scanning signal from the previous-level gate scanning line Sn−1.

The compensation module 12 is further connected to the current-level gate scanning line Sn, and configured to enable the gate electrode of the driving transistor DTFT to be electrically connected to the second electrode of the driving transistor DTFT within the threshold compensation time period of each display period under the control of the gate scanning signal from the current-level gate scanning line Sn.

The data writing module 13 is further connected to the current-level gate scanning line Sn, and configured to write the data voltage Vdata into the second end N2 of the storage capacitor Cs within the threshold compensation time period of each display period under the control of the gate scanning signal from the current-level gate scanning line Sn.

The resetting module 14 is further configured to receive a light-emitting control signal Em, and enable the current-level gate scanning line Sn to be electrically connected to the second end N2 of the storage capacitor Cs within the light-emitting time period of each display period under the control of the light-emitting control signal Em.

The light-emitting control module 15 is further configured to receive the light-emitting control signal Em, and enable the second electrode of the driving transistor DTFT to be electrically connected to the light-emitting element LE within the light-emitting time period of each display period under the control of the light-emitting control signal Em.

Figure 3:
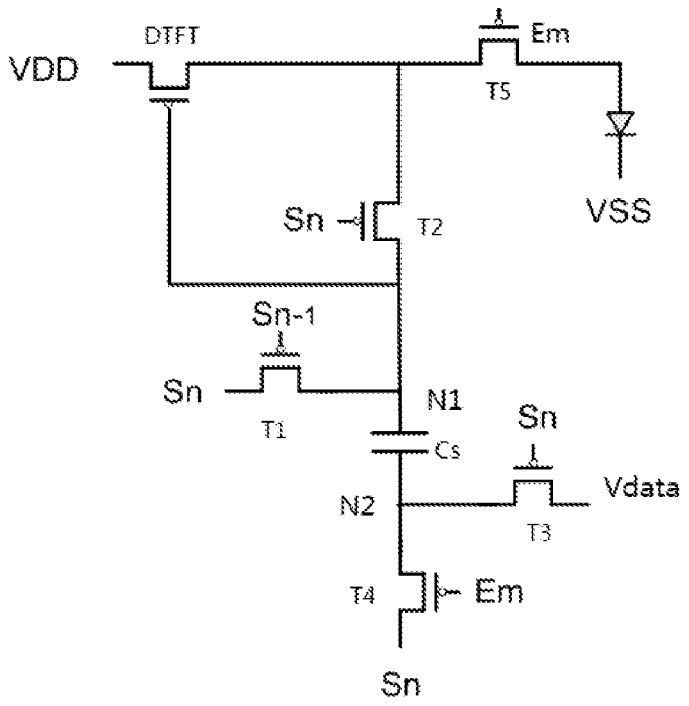
FIG. 3 is yet another schematic view showing the pixel circuit included in the display panel according to one embodiment of the present disclosure.

To be specific, as shown in FIG. 3, the initialization module 11 includes an initialization transistor T1, a gate electrode of which is connected to the previous-level gate scanning line Sn−1, a first electrode of which is connected to the current-level gate scanning line Sn, and a second electrode of which is connected to the first end of the storage capacitor Cs.

To be specific, the compensation module 12 includes a compensation transistor T2, a gate electrode of which is connected to the current-level gate scanning line Sn, a first electrode of which is connected to the second electrode of the driving transistor DTFT, and a second electrode of which is connected to the first end of the storage capacitor Cs.

To be specific, the data writing module 13 includes a data writing transistor T3, a gate electrode of which is connected to the current-level gate scanning line Sn, a first electrode of which is connected to the second end of the storage capacitor Cs, and a second end of which is configured to receive the data voltage Vdata.

To be specific, the resetting module 14 includes a resetting transistor T4, a gate electrode of which is configured to receive the light-emitting control signal Em, a first electrode of which is connected to the second end of the storage capacitor Cs, and a second electrode of which is connected to the current-level gate scanning line Sn.

To be specific, the light-emitting control module 15 includes a light-emitting control transistor T5, a gate electrode of which is configured to receive the light-emitting control signal, a first electrode of which is connected to the second electrode of the driving transistor DTFT, and a second electrode of which is connected to the light-emitting element LE.

To be specific, the driving transistor DTFT, the initialization transistor T1, the compensation transistor T2, the data writing transistor T3, the resetting transistor T4 and the light-emitting control transistor T5 are all p-type transistors.

The pixel circuit included in the display panel will be described hereinafter in more details.

In one embodiment of the present disclosure, the pixel circuit included in the display panel in FIG. 3 is configured to drive an organic light-emitting diode (OLED). As shown in FIGS. 2 and 3, the pixel circuit includes an OLED, a storage capacitor Cs, a driving transistor DTFT, an initialization module, a compensation module, a data writing module, a resetting module and a light-emitting control module.

The driving transistor DTFT is a p-type TFT, a gate electrode of which is connected to a first end N1 of the storage capacitor Cs, and a source electrode of which is configured to receive a high level VDD.

The initialization module includes an initialization transistor T1, a gate electrode of which is connected to a previous-level gate scanning line Sn−1, a first electrode of which is connected to the current-level gate scanning line Sn, and a second electrode of which is connected to the first end N1 of the storage capacitor Cs.

The compensation module includes a compensation transistor T2, a gate electrode of which is connected to the current-level gate scanning line Sn, a drain electrode of which is connected to a drain electrode of the driving transistor DTFT, and a source electrode of which is connected to the first end N1 of the storage capacitor Cs.

The data writing module includes a data writing transistor T3, a gate electrode of which is connected to the current-level gate scanning line Sn, a drain electrode of which is connected to a second end N2 of the storage capacitor Cs, and a source end of which is configured to receive a data voltage Vdata.

The resetting module includes a resetting transistor T4, a gate electrode of which is configured to receive a light-emitting control signal Em, a drain electrode of which is connected to the second end N2 of the storage capacitor Cs, and a source electrode of which is connected to the current-level gate scanning line Sn.

The light-emitting control module includes a light-emitting control transistor T5, a gate electrode of which is configured to receive the light-emitting control signal Em, a drain electrode of which is connected to the second electrode of the driving transistor DTFT, and a source electrode of which is connected to an anode of the OLED.

A cathode of the OLED is configured to receive a low level VSS.

In FIG. 3, DTFT, T1, T2, T3, T4 and T5 are all p-type transistors.

Figure 4:
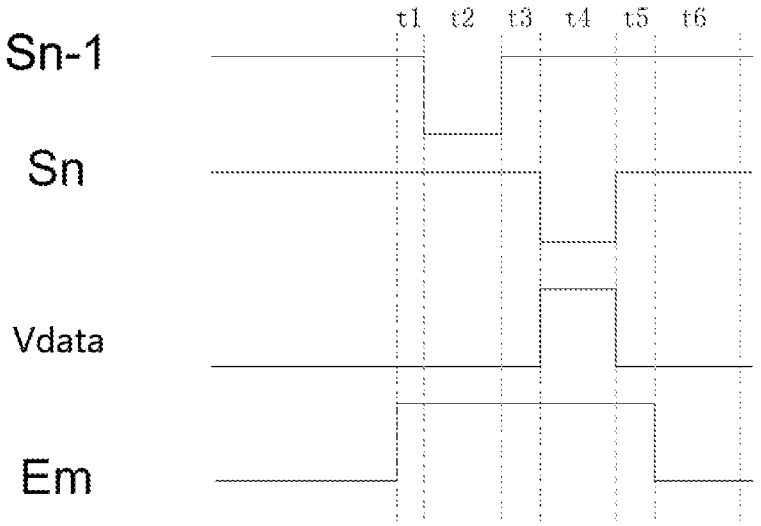
FIG. 4 is a sequence diagram of the pixel circuit in FIG. 3.

FIG. 4 is a sequence diagram of the pixel circuit in FIG. 3.

In one embodiment of the present disclosure, the pixel circuit included in the display panel includes:

a storage capacitor Cs;

a driving transistor DTFT, a gate electrode of which is connected to the first end of the storage capacitor Cs, and a source electrode of which is configured to receive the high level VDD;

an initialization module, a first end of which is connected to a current-level gate scanning line Sn, a second end of which is connected to the first end of the storage capacitor, and which is configured to apply an initial voltage to the first end N1 of the storage capacitor Cs via the current-level gate scanning line Sn within the initialization time period of each display period;

a compensation module configured to enable the gate electrode of the driving transistor DTFT to be electrically connected to a drain electrode of the driving transistor DTFT within the threshold compensation time period of each display period;

a data writing module configured to write a data voltage Vdata into a second end N2 of the storage capacitor Cs within the threshold compensation time period of each display period;

a resetting module, a first end of which is connected to the current-level gate scanning line Sn, a second end of which is connected to the second end of the storage capacitor Cs, and which is configured to enable the current-level gate scanning line Sn to be electrically connected to the second end of the storage capacitor Cs within the light-emitting time period of each display period; and a light-emitting control module configured to enable the drain electrode of the driving transistor DTFT to be electrically connected to an anode of the OLED within the light-emitting time period of each display period.

The driving transistor DTFT is in the on state within the light-emitting time period of each display period, so as to drive the OLED to emit light.

The initialization module includes an initialization transistor T1, a gate electrode of which is connected to a previous-level gate scanning line Sn−1, a first electrode of which is connected to the current-level gate scanning line Sn, and a second electrode of which is connected to the first end N1 of the storage capacitor Cs.

The compensation module includes a compensation transistor T2, a gate electrode of which is connected to the current-level gate scanning line Sn, a drain electrode of which is connected to the drain electrode of the driving transistor DTFT, and a second electrode of which is connected to the first end N1 of the storage capacitor Cs.

The data writing module includes a data writing transistor T3, a gate electrode of which is connected to the current-level gate scanning line Sn, a drain electrode of which is connected to the second end N2 of the storage capacitor Cs, and a source end of which is configured to receive the data voltage Vdata.

The resetting module includes a resetting transistor T4, a gate electrode of which is configured to receive the light-emitting control signal Em, a drain electrode of which is connected to the second end N2 of the storage capacitor Cs, and a source electrode of which is connected to the current-level gate scanning line Sn.

The light-emitting control module includes a light-emitting control transistor T5, a gate electrode of which is configured to receive the light-emitting control signal Em, a drain electrode of which is connected to the second electrode of the driving transistor DTFT, and a source electrode of which is connected to the anode of the OLED.

A cathode of the OLED is configured to receive a low level VSS.

As shown in FIG. 4, during the operation of the pixel circuit included in the display panel, within a time period t1 which is a first preparation time period, the previous-level gate scanning line Sn−1 outputs a high level, the current-level gate scanning line Sn outputs a high level, so as to maintain DTFT, T1, T2 and T3 in an off state, and pull up Em from a low level to a high level. At this time, T4 and T5 are switched from the on state into the off state, so as to be ready for the subsequent signal writing procedure.

Within a time period t2 which is an initialization time period, the initial voltage is applied to the first end N1 of the storage capacitor Cs via the current-level gate scanning line Sn under the control of the initialization module. Sn−1 outputs a low level so as to turn on T1. Sn continues to output a high level so as to turn off T2 and T3. Em is maintained at a high level so as to turn off T4 and T5. Sn outputs a high level signal to N1 via T1, so as to initialize N1. Within the time period t2, the initial voltage is applied to the first end N1 of the storage capacitor Cs via the current-level gate scanning line Sn, which effectively utilizes the current-level gate scanning line Sn, thereby to reduce the wires in the pixel space and facilitate to provide a high resolution.

Within a time period t3 which is a second preparation time period, Sn−1 is pulled up from a low level to a high level so as to turn off T1. Sn continues to output a high level, and Em is maintained at a high level, so as to turn off T2, T3, T4, T5 and DTFT for the subsequent signal writing procedure.

Within a time period t4 which is a threshold compensation time period, the data voltage Vdata is written into the second end of the storage capacitor Cs through the data writing module, and the gate electrode of the driving transistor DTFT is electrically connected to the drain electrode of the driving transistor DTFT under the control of the compensation module. Sn−1 continues to output a high level, and the gate scanning signal from Sn is pulled down from a high level to a low level. At this time, T2 and T3 are turned on, and Vdata is applied to N2 via T3. Because T2 is in the on state, the gate electrode of DTFT is electrically connected to the drain electrode thereof. Because the potential at N1 is a low level from Sn and the source electrode of DTFT receives the high level VDD, thus DTFT is in the diode conducting state until the potential at the gate electrode of DTFT is pulled up to VDD+Vth. Then, DTFT is maintained in the off state.

Within a time period t5 which is a third preparation time period, Sn−1 continues to output a high level, and the gate scanning signal from Sn is pulled up from a low level to a high level. At this time, a difference VN2−VN1 between potentials at the first end and the second end of Cs is equal to Vdata−VDD−Vth.

Within a time period t6 which is a light-emitting time period, the current-level gate scanning line Sn outputs the gate scanning signal VSn at a high level, and the first end of the storage capacitor Cs is in a floating state. The potential at the first end N1 of the storage capacitor Cs is jumped to VDD+Vth−Vdata+VSn, and the gate-to-source voltage Vgs of the driving transistor DTFT is VSn-Vdata, so an on-state current of the driving transistor DTFT is irrelevant to Vth and VDD.

To be specific, within the time period t6, Sn−1 and Sn both continue to output a high level, and Em is switched from a high level to a low level, so as to turn on T4 and T5. At this time, the gate scanning signal VSn from Sn is applied to N2 via T4. T2 is in the off state, so N1 is in the floating state. A voltage difference across Cs remains unchanged, so the potential at N1 is VDD+Vth−Vdata+VS, and the gate-to-source voltage Vgs of DTFT is VDD+Vth−Vdata+VSn−VDD. The on-state current Ion of DTFT may be calculated through the following formula: $Ion=K*(Vgs-Vth)^2=K*(VSn-data)$. Hence, the on-state current of DTFT is irrelevant to the threshold voltage of DTFT as well as VDD, and the OLED may stably emit light. Within the time period t6, the resetting voltage is applied to the second end N2 of the storage capacitor Cs via the current-level gate scanning line Sn, so it is able to effectively utilize the current-level gate scanning line Sn, thereby to reduce the wires in the pixel space and facilitates to provide a high resolution.

According to the pixel circuit in the embodiments of the present disclosure, the on-state current Ion of the driving transistor DTFT is in direct proportion to the square of a difference between the gate scanning signal VSn from Sn and Vdata, and Ion is irrelevant to the threshold of DTFT as well as VDD. As a result, it can avoid compensating for the threshold voltage drift and the IR-drop, thereby to enable the pixel circuit included in the display panel to display an image at the even brightness.

The present disclosure further provides in some embodiments a method for driving the display panel, which includes:

an initialization step of, within an initialization time period of each display period, enabling, by the initialization module, the current-level gate scanning line to apply the initial voltage to the first end of the storage capacitor;

a threshold compensation step of, within a threshold compensation time period of each display period, writing, by the data writing module, a data voltage Vdata into the second end of the storage capacitor, and enabling, by the compensation module, the gate electrode of the driving transistor to be electrically connected to the second electrode of the driving transistor; and a light-emitting step of, within a light-emitting time period of each display period, enabling, by the resetting module, the current-level gate scanning line to be electrically connected to the second end of the storage capacitor, and enabling, by the light-emitting control module, the second end of the driving transistor to be electrically connected to the light-emitting element, so as to enable the driving transistor to be in an on state, thereby to drive the light-emitting element to emit light.

According to the method in the embodiments of the present disclosure, the initial voltage may be applied to the first end of the storage capacitor via the current-level gate scanning line within the initialization time period of each display period, the current-level gate scanning line may be electrically connected to the second end of the storage capacitor within the light-emitting time period of each display period, and the resetting voltage may be applied to the second end of the storage capacitor via the current-level gate scanning line within the light-emitting time period. As a result, it is able to make effective use of the current-level gate scanning signal, i.e., apply the initial voltage and the resetting voltage through the current-level gate scanning line, while preventing the occurrence of the uneven brightness of the light-emitting element caused by a threshold voltage drift of the driving transistor and an IR-drop of a power line (the IR-drop refers to a voltage decreasing or increasing phenomenon occurring at a power supply and a ground network in an integrated circuit), thereby to reduce the wires in a pixel space and facilitate to display an image at a high resolution.

To be specific, in the case that the driving transistor is a p-type transistor, a first power voltage is a high level VDD and the initial voltage is a high level.

The threshold compensation step includes: within the threshold compensation time period of each display period, enabling the driving transistor to be in the diode conducting state until a potential at the gate electrode of the driving transistor is pulled up to VDD+Vth, where Vth is a threshold voltage of the driving transistor, and then turning off the driving transistor. A difference between potentials at the second end of the storage capacitor and at the first end of the storage capacitor is Vdata−VDD−Vth.

The light-emitting step includes: within the light-emitting time period of each display period, enabling a current-level gate scanning line to output a current-level gate scanning signal VSn at a high level, so as to enable the first end of the storage capacitor to be in a floating state, enable the potential at the first end of the storage capacitor to be jumped to VDD+Vth−Vdata+VSn and enable a gate-to-source voltage Vgs of the driving transistor to be VSn−Vdata, thereby to enable an on-state current of the driving transistor being irrelevant to Vth and VDD.

To be specific, prior to the initialization step, the method further includes a first preparation step of enabling the previous-level gate scanning line to output a high level, and enabling the current-level gate scanning line to output a high level, so as to enable the driving transistor, the initialization transistor, the compensation transistor and the data writing transistor to be in an off state, and pull up the light-emitting control signal from a low level to a high level, thereby to enable the resetting transistor and the light-emitting control transistor to be switched from an on state to an off state.

After the initialization step and before the threshold compensation step, the method further includes a second preparation step of enabling the previous-level gate scanning line to output a high level so as to enable the initialization transistor to be in the off state, and enabling the current-level gate scanning line output a high level continuously and maintaining the light-emitting control signal at a high level so as to enable the compensation transistor, the data writing transistor, the resetting transistor, the light-emitting control transistor and the driving transistor to be in the off state.

After the threshold compensation step and before the light-emitting step, the method further includes a third preparation step of enabling the previous-level gate scanning line to output a high level continuously, so as to pull up the current-level gate scanning signal from the current-level gate scanning line from a low level to a high level, and enable a difference between potentials at the first end and the second end of the storage capacitor to be Vdata−VDD−Vth.

The present disclosure further provides in some embodiments a display device including the above-mentioned display panel.

The display device may be any product or component having a display function, such as an electronic paper, an OLED display, a mobile phone, a flat-panel computer, a television, a displayer, a laptop computer, a digital photo frame or a navigator.

The above are merely the optional embodiments of the present disclosure. Obviously, a person skilled in the art may make further modifications and improvements without departing from the spirit of the present disclosure, and these modifications and improvements shall also fall within the scope of the present disclosure.

What is claimed is:

1. A display panel, comprising: a display substrate, a plurality of gate scanning lines on the display substrate, a plurality of data lines on the display substrate, and a plurality of pixel circuits;

wherein the plurality of gate scanning lines crosses the plurality of data lines, and each pixel circuit is at a pixel region defined by two adjacent gate scanning lines and two adjacent data lines;

wherein each pixel circuit comprises:

a storage capacitor;

a driving transistor, a gate electrode of which is connected to a first end of the storage capacitor, and a first electrode of which is configured to receive a first power voltage;

an initialization module, a first end of which is directly connected to a current-level gate scanning line, a second end of which is connected to the first end of the storage capacitor, and which is configured to enable the current-level gate scanning line to apply an initial voltage to the first end of the storage capacitor within an initialization time period of each display period;

a compensation module configured to enable the gate electrode of the driving transistor to be electrically connected to a second electrode of the driving transistor within a threshold compensation time period of each display period;

a data writing module configured to write a data voltage into a second end of the storage capacitor within the threshold compensation time period of each display period;

a resetting module, a first end of which is directly connected to the current-level gate scanning line, a second end of which is connected to the second end of the storage capacitor, and which is configured to enable the current-level gate scanning line to be electrically connected to the second end of the storage capacitor within a light-emitting time period of each display period; and a light-emitting control module configured to enable the second electrode of the driving transistor to be electrically connected to a light-emitting element within the light-emitting time period of each display period;

wherein the driving transistor is in an on state within the light-emitting time period of each display period so as to drive the light-emitting element to emit light.

2. The display panel according to claim 1, wherein the initialization module comprises an initialization transistor, a gate electrode of which is connected to a previous-level gate scanning line, a first electrode of which is connected to the current-level gate scanning line, and a second electrode of which is connected to the first end of the storage capacitor.

3. The display panel according to claim 1, wherein the compensation module comprises a compensation transistor, a gate electrode of which is connected to the current-level gate scanning line, a first electrode of which is connected to the second electrode of the driving transistor, and a second electrode of which is connected to the first end of the storage capacitor.

4. The display panel according to claim 1, wherein the data writing module comprises a data writing transistor, a gate electrode of which is connected to the current-level gate scanning line, a first electrode of which is connected to the second end of the storage capacitor, and a second end of which is configured to receive the data voltage.

5. The display panel according to claim 1, wherein the resetting module comprises a resetting transistor, a gate electrode of which is configured to receive a light-emitting control signal, a first electrode of which is connected to the second end of the storage capacitor, and a second electrode of which is connected to the current-level gate scanning line.

6. The display panel according to claim 1, wherein the light-emitting control module comprises a light-emitting control transistor, a gate electrode of which is configured to receive the light-emitting control signal, a first electrode of which is connected to the second electrode of the driving transistor, and a second electrode of which is connected to the light-emitting element.

7. The display panel according to claim 1, wherein the initialization module comprises an initialization transistor, a gate electrode of which is connected to a previous-level gate scanning line, a first electrode of which is connected to the current-level gate scanning line, and a second electrode of which is connected to the first end of the storage capacitor;

the compensation module comprises a compensation transistor, a gate electrode of which is connected to the current-level gate scanning line, a first electrode of which is connected to the second electrode of the driving transistor, and a second electrode of which is connected to the first end of the storage capacitor;

the data writing module comprises a data writing transistor, a gate electrode of which is connected to the current-level gate scanning line, a first electrode of which is connected to the second end of the storage capacitor, and a second end of which is configured to receive the data voltage;

the resetting module comprises a resetting transistor, a gate electrode of which is configured to receive a light-emitting control signal, a first electrode of which is connected to the second end of the storage capacitor, and a second electrode of which is connected to the current-level gate scanning line; and the light-emitting control module comprises a light-emitting control transistor, a gate electrode of which is configured to receive the light-emitting control signal, a first electrode of which is connected to the second electrode of the driving transistor, and a second electrode of which is connected to the light-emitting element.

8. The display panel according to claim 7, wherein the driving transistor, the initialization transistor, the compensation transistor, the data writing transistor, the resetting transistor and the light-emitting control transistor are all p-type transistors.

9. A method for driving the display panel according to claim 1, comprising:

an initialization step of, within an initialization time period of each display period, enabling, by an initialization module, a current-level gate scanning line to apply an initial voltage to a first end of a storage capacitor;

a threshold compensation step of, within a threshold compensation time period of each display period, writing, by a data writing module, a data voltage Vdata into a second end of the storage capacitor, and enabling, by a compensation module, a gate electrode of a driving transistor to be electrically connected to a second electrode of the driving transistor; and a light-emitting step of, within a light-emitting time period of each display period, enabling, by a resetting module, the current-level gate scanning line to be electrically connected to the second end of the storage capacitor, and enabling, by a light-emitting control module, the second end of the driving transistor to be electrically connected to a light-emitting element, thereby enabling the driving transistor to be in an on state to drive the light-emitting element to emit light.

10. The method according to claim 9, wherein when the driving transistor is a p-type transistor, a first power voltage is a high level VDD and the initial voltage is a high level;

the threshold compensation step comprises: within the threshold compensation time period of each display period, enabling the driving transistor to be in a diode conducting state until a potential at the gate electrode of the driving transistor is pulled up to VDD+Vth, where Vth is a threshold voltage of the driving transistor, and turning off the driving transistor; where a difference between potentials at the second end of the storage capacitor and at the first end of the storage capacitor is Vdata−VDD−Vth; and the light-emitting step comprises: within the light-emitting time period of each display period, enabling the current-level gate scanning line to output a current-level gate scanning signal VSn at a high level, thereby to enable the first end of the storage capacitor to be in a floating state, enable the potential at the first end of the storage capacitor to jump to VDD+Vth−Vdata+VSn and enable a gate-to-source voltage Vgs of the driving transistor to be VSn−Vdata, and thereby to enable an on-state current of the driving transistor being irrelevant to Vth and VDD.

11. The method according to claim 10, wherein the initialization module comprises an initialization transistor, a gate electrode of which is connected to a previous-level gate scanning line, a first electrode of which is connected to the current-level gate scanning line, and a second electrode of which is connected to the first end of the storage capacitor;

the compensation module comprises a compensation transistor, a gate electrode of which is connected to the current-level gate scanning line, a first electrode of which is connected to the second electrode of the driving transistor, and a second electrode of which is connected to the first end of the storage capacitor;

the data writing module comprises a data writing transistor, a gate electrode of which is connected to the current-level gate scanning line, a first electrode of which is connected to the second end of the storage capacitor, and a second end of which is configured to receive the data voltage;

the resetting module comprises a resetting transistor, a gate electrode of which is configured to receive a light-emitting control signal, a first electrode of which is connected to the second end of the storage capacitor, and a second electrode of which is connected to the current-level gate scanning line;

the light-emitting control module comprises a light-emitting control transistor, a gate electrode of which is configured to receive the light-emitting control signal, a first electrode of which is connected to the second electrode of the driving transistor, and a second electrode of which is connected to the light-emitting element;

before the initialization step, the method further comprises a first preparation step of enabling the previous-level gate scanning line to output a high level, and enabling the current-level gate scanning line to output a high level, thereby to enable the driving transistor, the initialization transistor, the compensation transistor and the data writing transistor to be in an off state, and pull up the light-emitting control signal from a low level to a high level, and thereby to enable the resetting transistor and the light-emitting control transistor to be switched from an on state to an off state;

after the initialization step and before the threshold compensation step, the method further comprises a second preparation step of enabling the previous-level gate scanning line to output a high level so as to enable the initialization transistor to be in the off state, and enabling the current-level gate scanning line to output a high level continuously and maintaining the light-emitting control signal at a high level so as to enable the compensation transistor, the data writing transistor, the resetting transistor, the light-emitting control transistor and the driving transistor to be in the off state; and after the threshold compensation step and before the light-emitting step, the method further comprises a third preparation step of enabling the previous-level gate scanning line to output a high level continuously, so as to pull up the current-level gate scanning signal from the current-level gate scanning line from a low level to a high level, and enable a difference between potentials at the first end and the second end of the storage capacitor to be Vdata−VDD−Vth.

12. A display device, comprising: the display panel according to claim 1.

13. The display panel according to claim 1, wherein a third end of the initialization module is connected to a previous-level gate scanning line, and the initialization module is further configured to enable the current-level gate scanning line to apply an initial voltage to the first end of the storage capacitor within the initialization time period of each display period via the current-level gate scanning line under the control of a gate scanning signal from the previous-level gate scanning line.

14. The display panel according to claim 1, wherein the resetting module is further configured to receive a light-emitting control signal and enable the current-level gate scanning line to be electrically connected to the second end of the storage capacitor within the light-emitting time period of each display period under the control of the light-emitting control signal.

* * * * *